US009091149B2

(12) United States Patent
Alberty et al.

(10) Patent No.: US 9,091,149 B2
(45) Date of Patent: Jul. 28, 2015

(54) PREDICTION AND DIAGNOSIS OF LOST CIRCULATION IN WELLS

(75) Inventors: Mark William Alberty, Houston, TX (US); Mark Aston, Teddington (GB); Juan Carlos Rojas, Katy, TX (US); Randall Sant, Katy, TX (US); Jianguo Zhang, Katy, TX (US)

(73) Assignee: BP Corporation North America Inc., Houston, TX (US)

( * ) Notice: Subject to any disclaimer, the term of this patent is extended or adjusted under 35 U.S.C. 154(b) by 657 days.

(21) Appl. No.: 13/468,401

(22) Filed: May 10, 2012

(65) Prior Publication Data

US 2013/0299241 A1 Nov. 14, 2013

(51) Int. Cl.

| | |
|---|---|
| ***E21B 47/10*** | (2012.01) |
| ***E21B 44/00*** | (2006.01) |
| ***E21B 21/00*** | (2006.01) |

(52) U.S. Cl.

CPC ..... *E21B 47/10* (2013.01); *E21B 21/003* (2013.01); *E21B 44/00* (2013.01)

(58) Field of Classification Search

CPC ..... E21B 47/10; E21B 21/003; E21B 44/00

See application file for complete search history.

(56) References Cited

U.S. PATENT DOCUMENTS

| | | | | |
|---|---|---|---|---|
| 4,914,433 | A * | 4/1990 | Galle | 340/854.4 |
| 6,518,224 | B2 * | 2/2003 | Wood | 507/118 |
| 2009/0188718 | A1 | 7/2009 | Kaageson-Loe et al. | |
| 2011/0108325 | A1 * | 5/2011 | Hartmann et al. | 175/26 |
| 2014/0032192 | A1 * | 1/2014 | Zamora et al. | 703/10 |

OTHER PUBLICATIONS

PCT Search Report issue in International Application No. PCT/US2012/037254, mailed on Feb. 12, 2013, 11 pages.

* cited by examiner

*Primary Examiner* — Giovanna C Wright
*Assistant Examiner* — Richard Alker
(74) *Attorney, Agent, or Firm* — John P. Poliak

(57) ABSTRACT

In accordance with aspects of the present disclosure, techniques for predicting, classifying, preventing, and remedying drilling fluid circulation loss events are disclosed. Tools for gathering relevant data are disclosed, and techniques for interpreting the resultant data as giving rise to an actual or potential drilling fluid lost circulation event are also disclosed.

28 Claims, 8 Drawing Sheets

PREDICTION AND DIAGNOSIS OF LOST CIRCULATION IN WELLS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

Drilling boreholes (e.g., for oil or natural gas wells) sometimes includes the use of drilling fluid, also known as "drilling mud." Drilling fluid serves to provide counter-pressure against formation pressure as well as to lubricate the drill bit and carry cuttings for hole cleaning. Drilling fluid is typically pumped from a surface mud tank (or "mud pit") down the drill pipe, so as to exit the drill bit at the end of the drill string. There, it provides its lubrication, sealing and cleaning functions. Thereafter, the drilling fluid flows up the annulus of the drill string and back to the surface. At the surface, the drilling fluid is cleaned of debris and returned to the reservoir, where it is re-used. Thus, drilling fluid flows in a loop, from the surface, to the bottom of the borehole, and back. This flow is referred to as drilling fluid "circulation."

While it is normal to lose some drilling fluid in the circulation process, excessive lost drilling fluid is expensive in terms of unit mud costs (especially whole synthetic or low toxicity mineral oil mud) and non-productive time. It may pose safety related concerns, as drilling fluid is bulky, difficult to mix, difficult to store and excessive losses may reduce the counter balance effect against formation fluids. Thus, there is a need for diagnosing root cause(s) of, predicting, preventing and correcting, drilling fluid lost circulation events.

BRIEF SUMMARY

In accordance with some aspects of the present disclosure, a method of diagnosing a cause of a drilling fluid lost circulation event is disclosed. The method may include recording data regarding: a rate of drilling fluid loss at the time of the event; cumulative drilling fluid losses as a function of drilling depth; borehole material electrical resistivity as a function of drilling depth; a predicted pore pressure at the time of the event; a predicted fracture gradient at the time of the event; leak-off test behavior prior to or at the time of the event; porosity and permeability information of material at an estimated location of the event; a rate of drilling fluid loss at a time after a lost circulation pill treatment; a borehole image; gamma ray emissions of material at an estimated location of the event; a tectonic regime of material at an estimated location of the event; an equivalent circulation density at an estimated location of the event; borehole temperature as a function of drilling depth; drilling fluid salinity; presence of fractures at an estimated location of the event; fault conductivity at an estimated location of the event; drilling fluid gain when drilling fluid is not being pumped; borehole trajectory; and drill bit drag and penetration rate at the time of the event. The method may also include classifying, based on the data, the event as at least one of: seepage; borehole breathing; induced axial fracture; induced near-orthogonal fracture; natural fracture; vugulars; and ineffective isolation of casing shoe. The method may further include implementing measures, based on the classifying, to at least partially cure the event.

DETAILED DESCRIPTION

This disclosure proceeds as follows. Section I discusses causes of drilling fluid lost circulation events. Section II discusses observable physical parameters, and tools for their measurement, that affect drilling fluid circulation losses. Section III discusses correlating the observable parameters to drilling fluid lost circulation event causes. Section IV discusses remedies for the different types of drilling fluid lost circulation event causes.

I. Drilling Fluid Lost Circulation Event Causes

Figure 1:
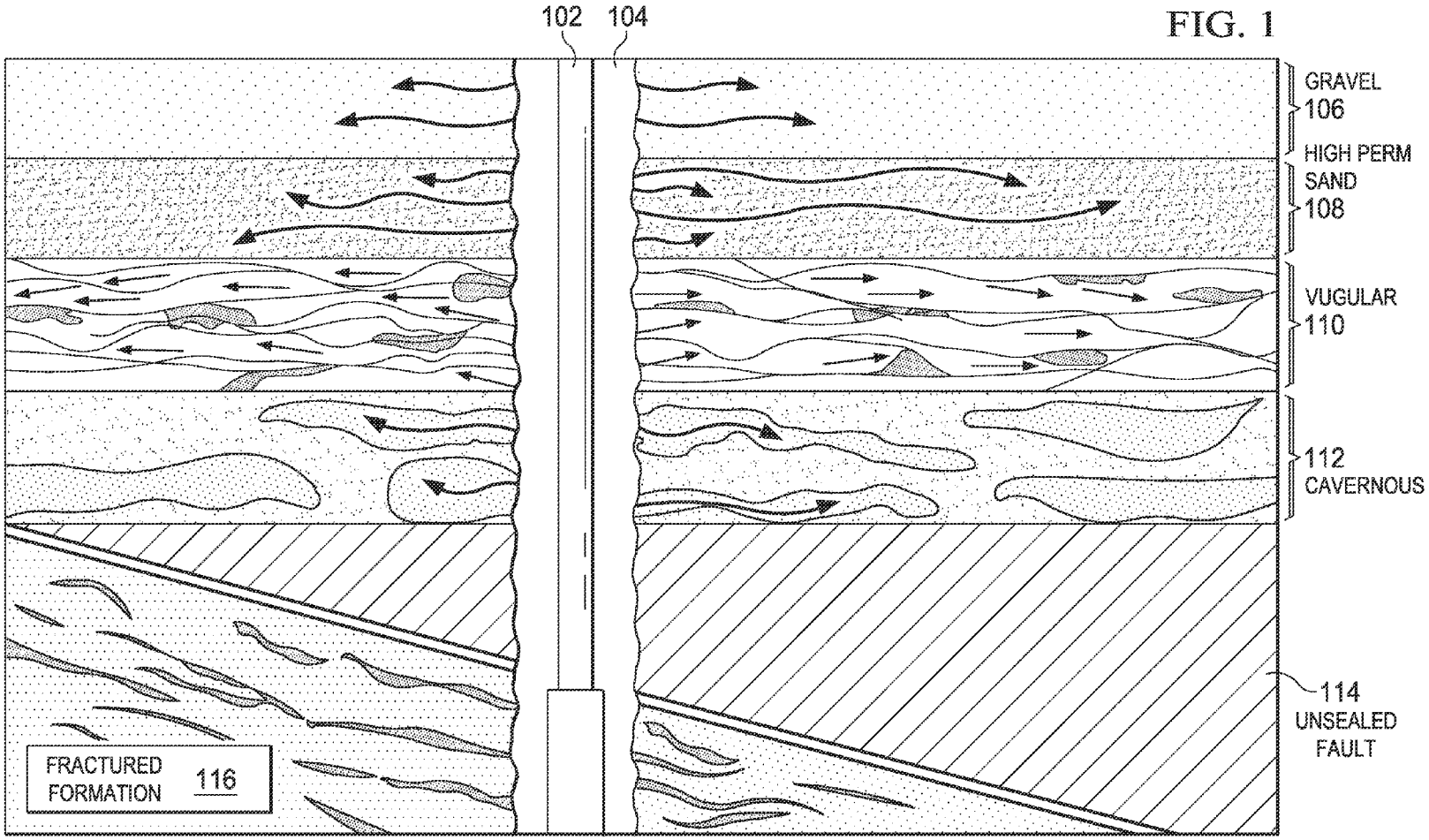
FIG. 1 is a schematic diagram representing several types of drilling fluid lost circulation causes.

FIG. 1 is a schematic diagram representing several types of drilling fluid lost circulation causes. In particular, FIG. 1 depicts drill string 102 in borehole 104. Represented schematically are several types of formations 106-116 that may cause drilling fluid circulation loss.

Drilling fluid circulation loss may occur via seepage into porous material such as gravel 106 and certain types of sand, e.g., high permeability sand 108. Drilling fluid may be lost within the matrix permeability of a formation. Pores between formation grains permit drilling fluid to enter the formation and be lost from circulation.

Drilling fluid may be lost to vugular formations 110 or cavernous formations 112. Such formations 110, 112 arise as portions of a formation are dissolved or decomposed over geologic time. The voids may form in dolomite or limestone and may range in size from small worm holes to networks of very large caverns. Such voids may receive drilling fluid and cause circulation loss.

Drilling fluid may be lost to naturally occurring faults 114 or fractured formations 116. Naturally occurring faults 114 and fractured formations 116 may appear in any type of formation, but are particularly common in carbonates. Many factors, such as fluid pressure, folding, faulting, release of lithostatic pressure, dehydration and cooling may result in brittle failure and natural fractures. They are commonly found in tectonically disturbed areas surrounding salt domes and along mountain fronts. Fractures may be activated through depletion of formation in the area of the fault.

Another cause of drilling fluid circulation loss is borehole breathing. Borehole breathing is defined as the condition when a limited amount of drilling fluid, typically on the order of a few tens of barrels, is lost when the drilling fluid pumps are on, and then a similar amount of drilling fluid is gained when the pumps are turned off. These gains and losses are typically not continuous and usually only occur at a time when the pumps are turned on or off.

Borehole breathing is often observed in locations where the operation pressure window (difference between the pore pressure and the fracture gradient) is very narrow or when the equivalent circulation density (ECD) is close to the fracture gradient and the temperature of the circulated drilling fluid is significantly lower than that of the formation temperature. It is likely that borehole breathing is associated with the opening and closing of induced fractures (discussed below) local to the well. This suggests that there are conditions set up by the presence of the well that have led to a lower fracture gradient near the well relative to the fracture gradient further away from the well. The different local fracture gradient may be due to thermal effects (e.g., drilling fluid significantly cooler than the formation) or chemical effects (e.g., drilling fluid significantly higher saline than fluid in the formation).

Borehole breathing should be distinguished from kick, which is characterized by a flow of formation fluids into the wellbore during drilling due to borehole pressure being less than that of formation fluids (due to, for example, use of drilling fluid of too low weight or motion in the drillstring or casing).

Another cause of drilling fluid lost circulation is induced axial (vertical) fractures. Mud weight, ECD, and pressure surge in the wellbore directly affect hoop stress and radial stress. (Hoop stress may be defined as circumferential stresses that follow the perimeter of the wellbore that result due to the presence of the wellbore; radial stress may be defined as stresses that point toward or away from the center of the borehole when viewed as a cross-section). For example, an increase in drilling fluid weight will cause a decrease in hoop stress and an increase in radial stress. Whenever hoop or radial stress becomes tensile (negative), the formation is prone to loss of circulation caused by induced axial fractures.

Induced axial fractures typically occur in the weakest formation. They may happen when the ECD is increased, while weighting up, tripping, using an excessive rate of penetration, when killing a kick, or as the result of a mud ring or other situation causing a temporary pressure surge that breaks down a weak formation. An induced axial fracture can occur in any formation type.

Induced axial fractures are related to borehole breathing. In borehole breathing, a local fracture is induced because the near wellbore fracture gradient is less than the far field fracture gradient, and the ECD is between those quantities. However, when the ECD exceeds both the near and far field fracture gradient, induced fractures continue to grow and significant loss of drilling fluid can occur. Typically, fracture length is a few feet to hundreds of feet, and fracture width (aperture) is less than one millimeter up to about 25 millimeters. However, fracture dimensions vary greatly.

Another cause of drilling fluid circulation loss is induced near-orthogonal (horizontal) fractures. Such fractures may be generated in the thrust/reverse stress region when overburden stress is overcome by high mud weight or ECD. The in-situ stress state (normal, strike-slip or over-thrust/reverse) may change with depth, geological structure (e.g., salt), depletion, and in different regions. At shallow locations (e.g., 2,500 feet or less), the horizontal stresses may exceed vertical stress. Abnormally high horizontal stress may exist in the subsalt formation.

Another cause of drilling fluid circulation loss is unplanned holes in the casing. While drilling directional and horizontal wells, casing wear is a potential problem. Factors related to casing wear include drillpipe hand banging, hole deviation, and, in particular, dogleg severity.

Another cause of drilling fluid circulation loss is ineffective isolation of the casing shoe. A casing shoe is the termination of a bottom section of casing, i.e., the bottom of a casing string. Casing shoes are typically cemented in place during a cement pumping job, which places cement around the bottom of the shoe, thereby isolating any new formation drilled out of that casing shoe from shallower formations behind the casing. If the cement job fails to effectively isolate the casing shoe from the shallower formation, drilling fluid lost circulation can occur.

II. Diagnostic Parameters and Tools

This section discusses many tools and associated parameters that may be used to diagnose the cause of a drilling fluid lost circulation event.

A first parameter regarding diagnosing drilling fluid lost circulation and root cause analysis is the rate of loss. This parameter is of fundamental importance, and may be measured in, e.g., barrels per hour (of lost fluid). In general, this parameter may be measured in terms of volume units per time units. This parameter may be determined by monitoring drilling fluid pumps and fluid levels in the surface drilling fluid storage pits.

A second parameter regarding diagnosing drilling fluid lost circulation and root cause analysis is cumulative loss as a function of drilling depth (for example, measured in barrels per foot). This parameter may be determined by monitoring the position of the drillstring and the drilling fluid pumps. Note that here, as well as in the rest of this disclosure, a first parameter as a function of a second parameter means that, for at least two different values of the second parameter, corresponding values of the first parameter are known. Typically, many pairs of values are known.

Figure 2:
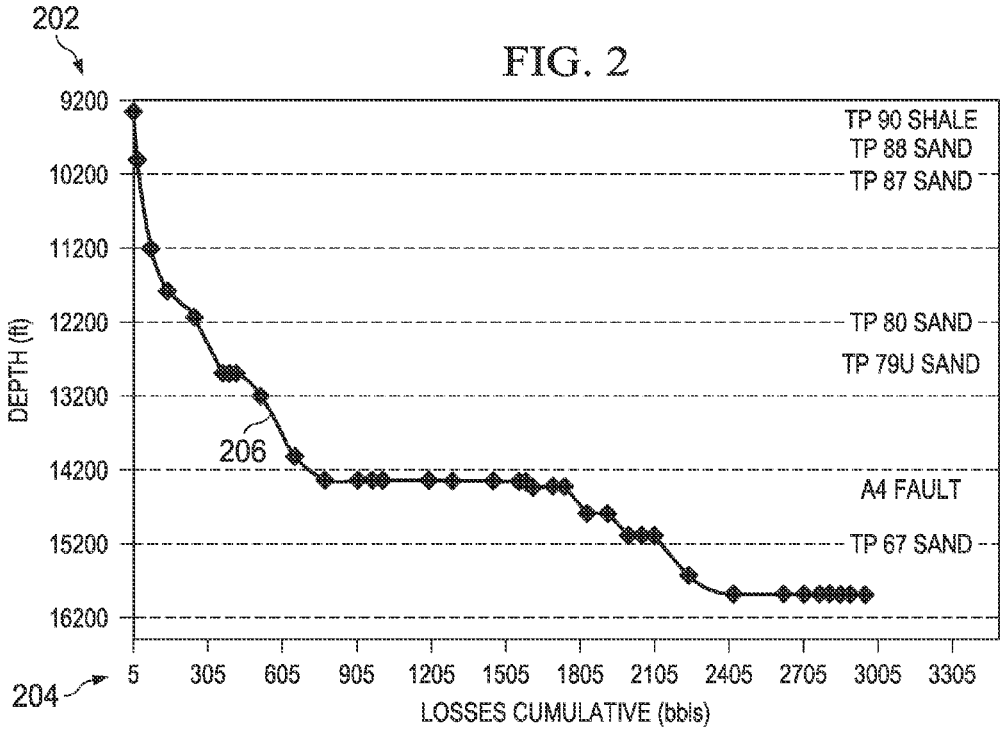
FIG. 2 depicts an example graph of cumulative drilling fluid loss as a function of drilling depth.

FIG. 2 depicts an example graph of cumulative drilling fluid loss as a function of drilling depth. In particular, FIG. 2 depicts drilling depth 202 on the y-axis and cumulative losses 204 on the x-axis. Note the substantial losses 206 occurring at about 14,300 feet.

A third parameter regarding diagnosing drilling fluid lost circulation and root cause analysis is electrical resistivity as a function of depth. In general, resistivity is a fundamental material property that represents how strongly a material opposes the flow of electrical current. Most rock materials are essentially insulators, while their enclosed fluids are generally conductive (with the exception of hydrocarbons). When a formation is porous and contains salty water, the overall resistivity will be low. When the formation contains hydrocarbons, the resistivity will be high. This parameter is typically used only with oil-based drilling fluids. It may be measured using a set of electrodes introduced into the borehole after drilling has occurred, or the electrodes may be present in the drill string itself. When lost circulation has occurred, a repeat measurement of resistivity may indicate where lost circulation has occurred as a function of oil based mud invading saline formations with a corresponding change in resistivity.

Figure 3:
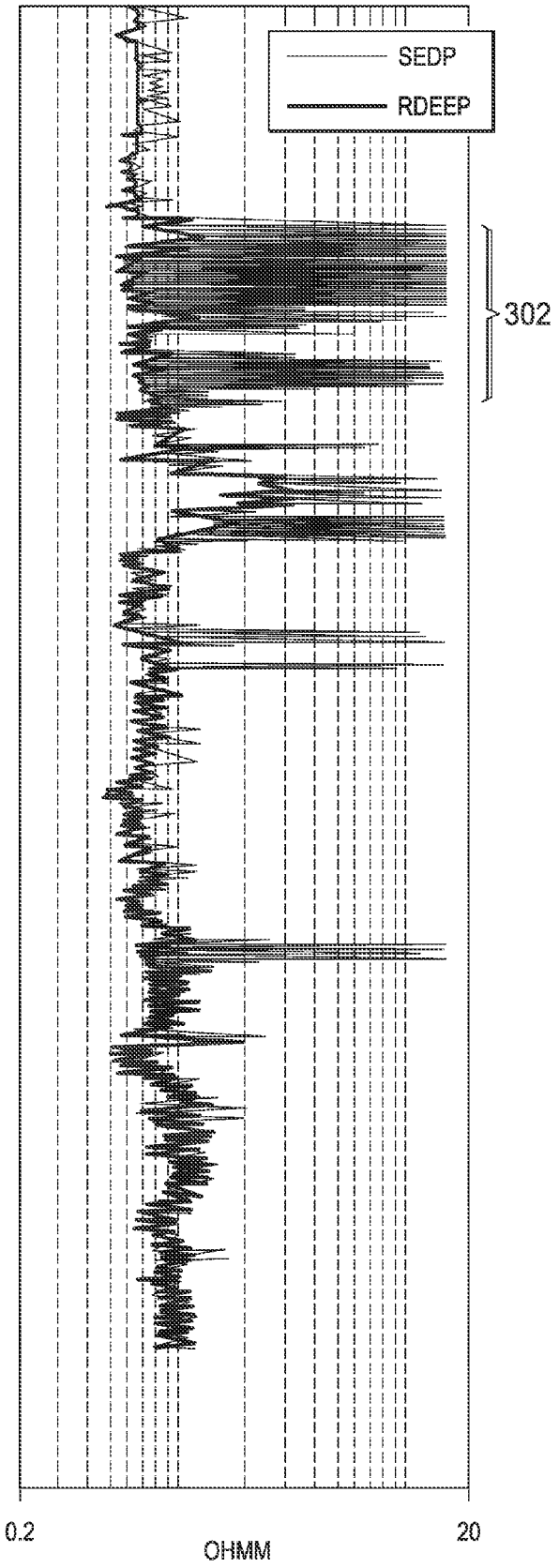
FIG. 3 depicts an example plot of electrical resistance as a function of depth.

FIG. 3 depicts an example plot of electrical resistance as a function of depth. In FIG. 3, the y-axis represents depth, and the x-axis represents ohms on a logarithmic scale, from 0.2Ω to 20Ω. Zone 302 corresponds to an induced fracture and subsequent drilling fluid lost circulation.

A fourth parameter regarding diagnosing drilling fluid lost circulation and root cause analysis is pore pressure and fracture gradient as a function of depth. As used herein, pore pressure means the pressure of fluids in a formation's pores; fracture gradient means the pressure required to induce a fracture. These parameters are particularly effective for determining the location of drilling fluid losses. Pore pressure and fracture gradient can be measured in some instances by using specialized tools or performing specific wellbore tests.

Figure 4:
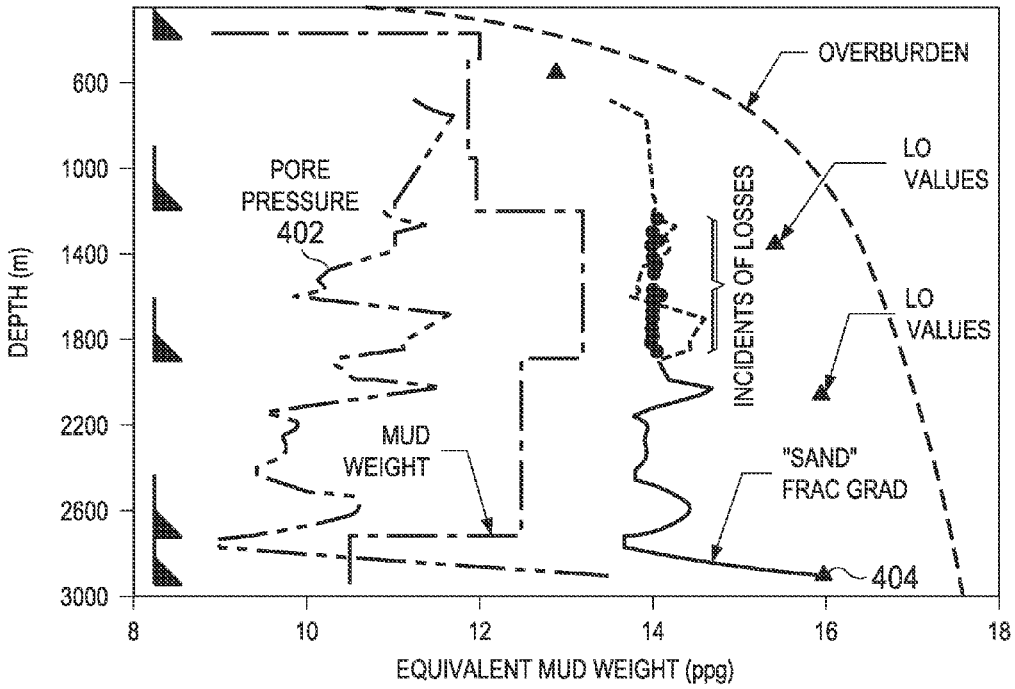
FIG. 4 depicts an example plot of pore pressure and fracture gradient as a function of depth.

FIG. 4 depicts an example plot of pore pressure 402 and fracture gradient 404 as a function of depth. The x-axis represents equivalent mud weight, and the y-axis represents depth. Note that losses occurred in the ranges 1220-1420 m and 1660-1800 m.

A fifth parameter regarding diagnosing drilling fluid lost circulation and root cause analysis is porosity information. Such information includes porosity, permeability and pore throat size. Notably, any of these parameters may be derived from any other of these parameters, as is known to those of skill in the art. Accordingly, "porosity information" is used throughout this disclosure to refer to any, a combination, or all of these three parameters. Porosity information may be measured using tests run on formation core or from analysis on measurements made of the formation down-hole.

A sixth parameter regarding diagnosing drilling fluid lost circulation and root cause analysis is pill behavior. A "pill" according to this disclosure is a relatively small quantity (e.g., less than 200 barrels) of specialized (e.g., high viscosity) drilling fluid. Usually, rate of loss is reduced once a high-viscosity pill reaches a loss zone. Accordingly, tracking rate of loss as affected by pill position can assist in locating loss zones. Pill position itself may be determined by roughly estimating volumetric capacities of the drill string, open hole and cased hole sections and comparing them to the volumetric capacity of each stroke of the rig pumps and the pump rate.

A seventh parameter regarding diagnosing drilling fluid lost circulation and root cause analysis is borehole imaging. Borehole images may be generated by measuring something sensitive to the difference between rock and drilling fluid; such as density, acoustic velocity, resistivity or gamma rays (the latter being affected by the presence of different elemental isotopes). The measurement instrument may be lowered into the borehole after drilling, or may be attached to the drillstring itself. One application of such images is to locate and identify fractures as induced or natural, horizontal or vertical.

An eighth parameter regarding diagnosing drilling fluid lost circulation and root cause analysis is lithology. Here, "lithology" means identification of rock material. This parameter is related to diagnosing drilling fluid lost circulation and root cause analysis because different materials have different properties such as permeability, strength, stiffness and deformation. For example, high natural permeability is normal for gravels and coarse sandstone, while shale has a higher fracture strength than sandstones. Lithology can be obtained from gamma ray logs, which are used to characterize the type of rock or sediment in a borehole. Different types of rock emit different amount of gamma radiation in a predictable manner. For example, shales usually emit more gamma radiation than other sedimentary rock.

A ninth parameter regarding diagnosing drilling fluid lost circulation and root cause analysis is tectonic regime. Here, "tectonic regime" generally refers to whether the geological environment has a normal stress regime, a strike-slip stress regime, or a thrust (reverse) stress regime. These environments are determined by the relation between the horizontal stresses and the vertical stresses.

Figure 5A:
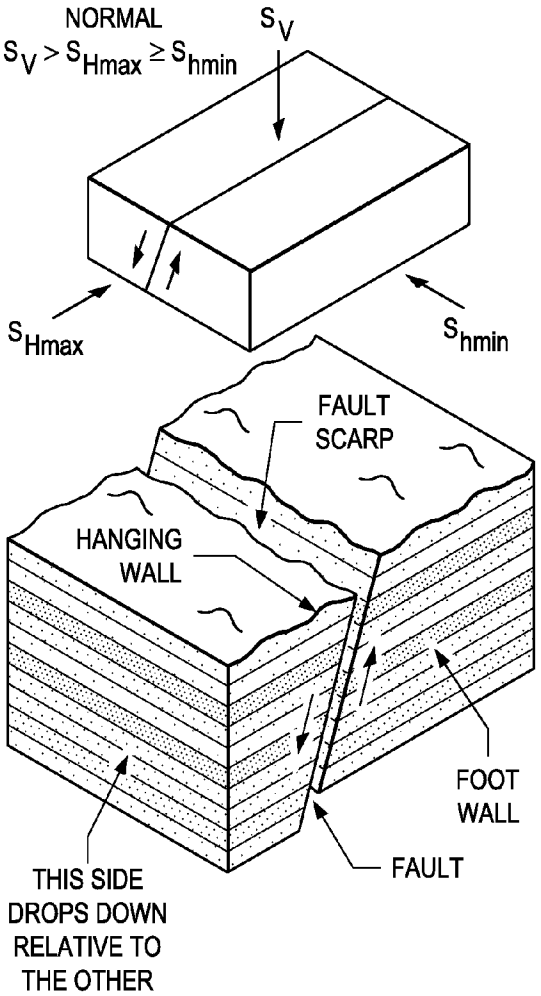
FIGS. 5A-C depict three types of tectonic regimes.
Figure 5B:
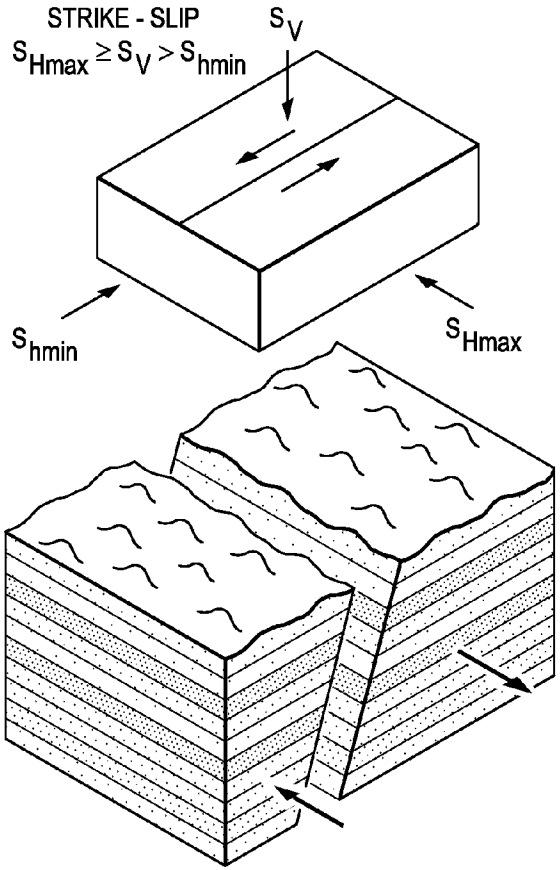
Figure 5C:
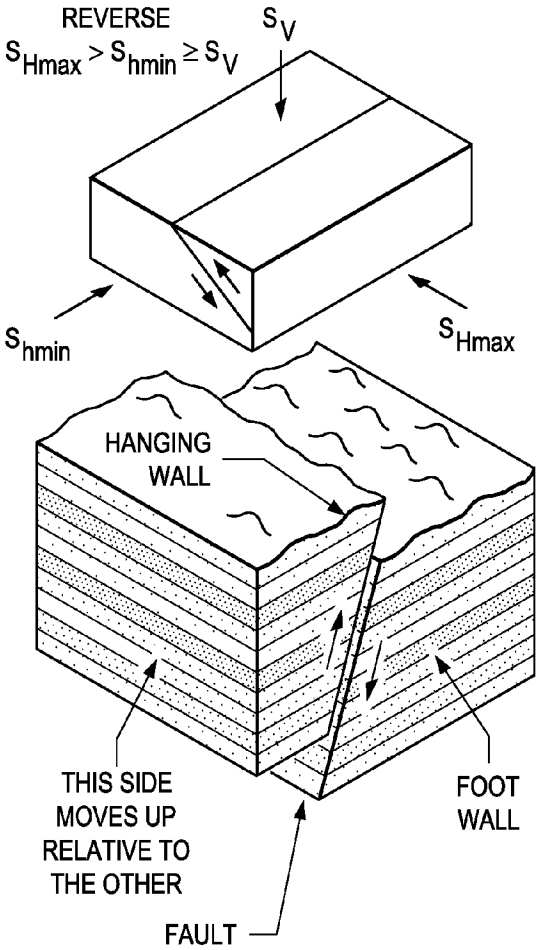

FIGS. 5A-C depict three types of tectonic regimes. In a normal tectonic regime 502 shown in FIG. 5A, $S_v > SH \geq S_h$, where $S_v$ is total overburden stress, $S_h$ is minimum horizontal stress present (identified with fracture gradient in this disclosure), and $S_H$ is maximal horizontal stress present. In a strike-slip tectonic regime shown in FIG. 5B, $S_H \geq S_v > S_h$. In a reverse tectonic regime shown in FIG. 5C, $S_H > S_h S_v$.

A tenth parameter regarding diagnosing drilling fluid lost circulation and root cause analysis is annular pressure response to drilling fluid pump activation and deactivation. Dull, exponential responses indicate potential borehole breathing or induced near-wellbore fractures. Annular pressure may be measured by a PWD (Pressure While Drilling) tool in the drill string.

Figure 6A:
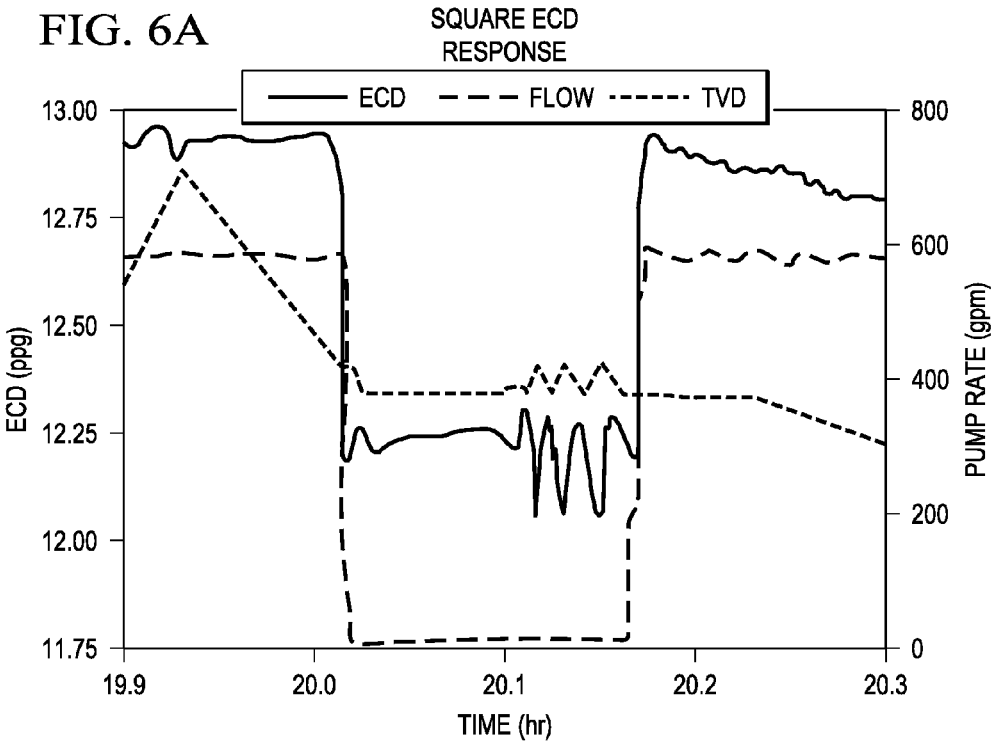
FIGS. 6A-B depict example equivalent circulating density responses during a connection, when drilling fluid circulation is temporarily halted.
Figure 6B:
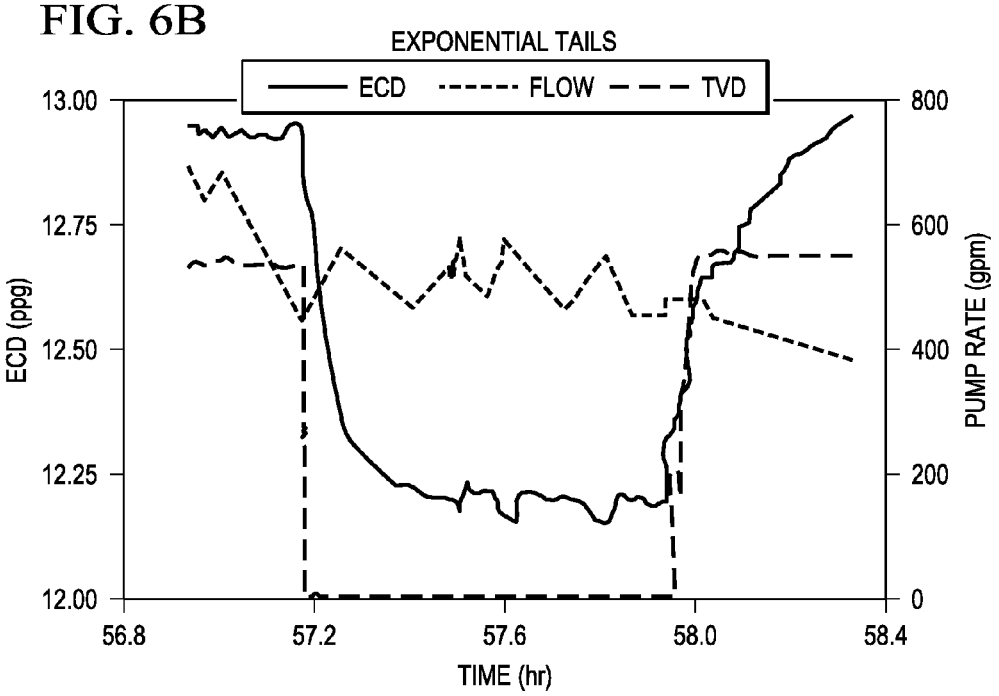

FIGS. 6A-B depict example ECD responses during a connection, when drilling fluid circulation is temporarily halted. Sharp responses for non-fractured rock shown in FIG. 6A indicate a lack of fluid loss, whereas dull, exponential responses for fractured rock shown in FIG. 6B indicate a fractured formation.

An eleventh parameter regarding diagnosing drilling fluid lost circulation and root cause analysis is near-wellbore formation temperature as a function of depth. Changes in temperature in the near-wellbore region occur at all times in the open hole. Formations near the bit may be cooled by the passage of cooler drilling fluid from the drill pipe. Further up in the hole section, formations may become warmed by the passage of hotter drilling fluid from below. When circulation stops for a period of time, near borehole temperatures revert to their in-situ values. All of these temperature changes cause an alteration in local stresses, which can affect lost circulation. When lost circulation occurs, abnormal deviations in the temperature gradient can be used to pinpoint the location of the lost zone. Temperature may be determined using a thermocouple or other conventional device, which may be lowered into the borehole after drilling or may be attached to the drill string itself.

Figure 7:
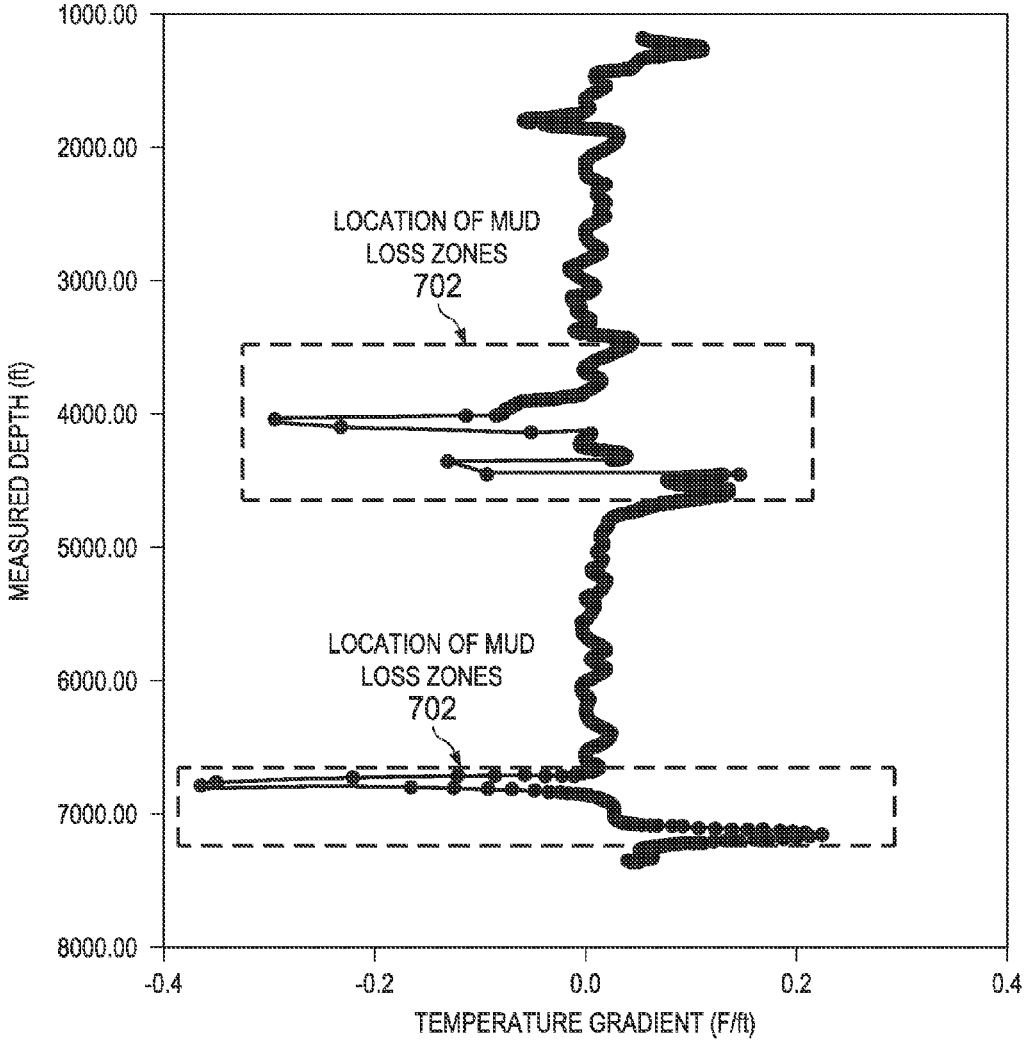
FIG. 7 depicts an example plot of temperature gradient as a function of depth.

FIG. 7 depicts an example plot of temperature gradient as a function of depth. The x-axis represents temperature gradient (degrees Fahrenheit per foot) and the y-axis represents depth. Temperature discontinuities 702 indicate potential locations of drilling fluid loss zones.

A twelfth parameter regarding diagnosing drilling fluid lost circulation and root cause analysis is drilling fluid salinity. Typically, drilling fluid salinity is selected by the well operator. Drilling fluid salinity affects osmotic pressure between the wellbore and surrounding material, and thus affects wellbore instability. Typically, an operator has control over salinity when the drilling fluid is mixed or received from a vendor.

A thirteenth parameter regarding diagnosing drilling fluid lost circulation and root cause analysis is seismic data, in particular, the location of natural faults. Such data may be gathered using known seismic techniques.

A fourteenth parameter regarding drilling fluid lost circulation is fault or natural fracture conductivity analysis. All rocks are faulted or fractured to some extent, and these can affect lost circulation. Stresses may be altered in the vicinity of faults, and zones of mechanical damage to the formation may extend for several hundred feet from the fault zone in some rock types. The orientation of the fault with respect to the regional stress will influence the likelihood of incurring losses into the fault when it is intersected by the wellbore. In order to analyze the conductivity of faults or fractures, in-situ stresses (overburden, maximum and minimum horizontal stresses) is first resolved into three principle stresses on fault or natural fracture planes through a coordinate transform. Then a 3D Mohr diagram can be developed. If the stresses lie above the critical frictional line (e.g., $\mu$=0.6), the fault or natural fracture is in a critically stressed state. These fault or natural fractures are most likely conductive.

Figure 8A:
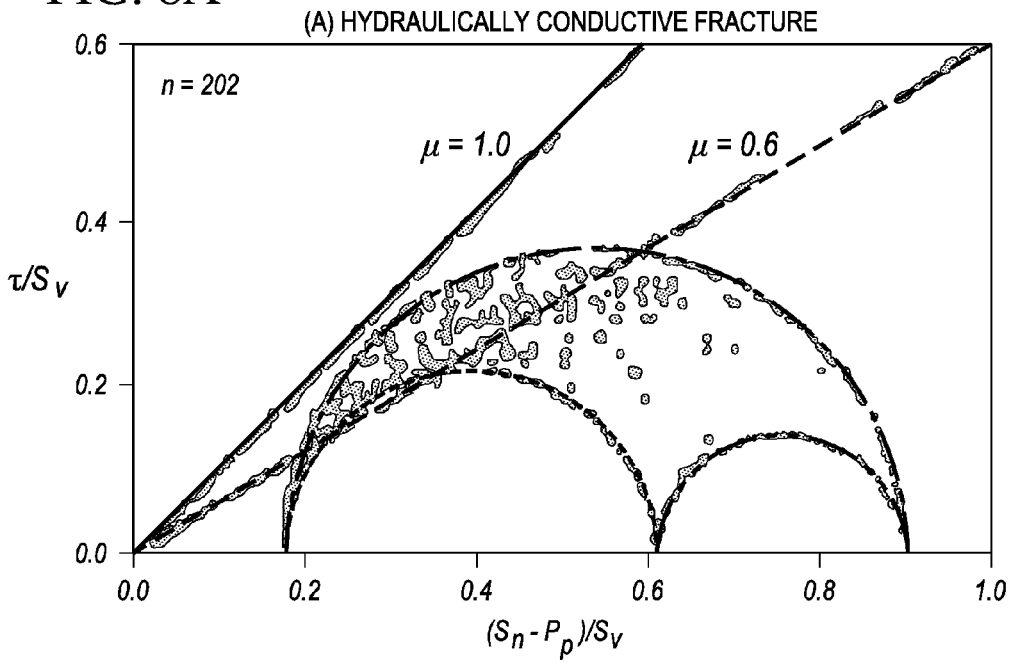
FIGS. 8A-B depict two example Mohr diagrams.
Figure 8B:
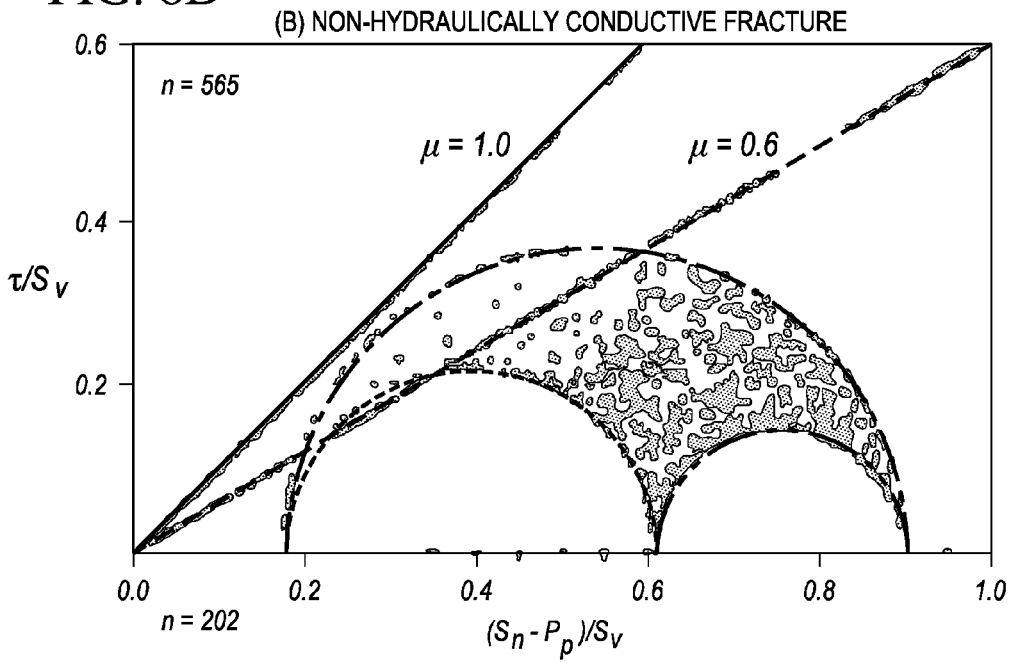

FIGS. 8A-B depict two example Mohr diagrams. FIG. 8A depicts hydraulically conductive fractures, and FIG. 8B depicts non-hydraulically conductive fractures. Each fault is represented by a dot. Critically stressed faults lie in the range between $\mu$=0.6 and $\mu$=0.9. Drilling through critically stressed faults may result in lost circulation and fault slip, causing tight hole problems. Most non-hydraulically conductive faults lie below the critical line $\mu$=0.6.

A fifteenth parameter regarding diagnosing drilling fluid lost circulation and root cause analysis is drill bit depth when losses occur. Once the drill bit reaches a natural loss zone (e.g., unconsolidated sand, caverns, vugular formations), losses may occur. For losses into caverns or vugular formations, the bit drops through a void preceded by a drilling break.

A sixteenth parameter regarding diagnosing drilling fluid lost circulation and root cause analysis is connection or trip gas behavior. Connection or trip gas is gas that is introduced in the wellbore when the drilling fluid circulation pumps are cut off. In instances where borehole breathing is occurring, fracture opening and closing may cause gas infused mud to come into the wellbore when the pumps are shut off. This may manifest itself on surface as a connection or pumps-off gas event. Connection or trip gas may be detected by flame ionization detectors on the rig.

A seventeenth parameter regarding diagnosing drilling fluid lost circulation and root cause analysis is well trajectory. Well trajectory affects anisotropy including in-situ stress and rock mechanical properties. Drilling fluid lost circulation may occur when the well trajectory is in an adverse orientation with an in-situ stresses and naturally-occurring fractured or faulted formations. In particular, as borehole angle increases, the drilling fluid weight window between the upper limit (above which loss circulation occurs) and the lower limit) below which wellbore instability occurs) becomes more narrow in normal in-situ stress state (overburden>maximum horizontal stress>minimum horizontal stress). Wellbore trajectory should be optimized considering wellbore stability, lost circulation mitigation and reservoir management.

An eighteenth parameter regarding diagnosing drilling fluid lost circulation and root cause analysis is casing physical integrity, which may be determined by pressure testing. The behavior of the pressure build-up response can identify whether there is a leak in the casing. It is also used as a comparison to the integrity tests done on exposed formation as a baseline for predicting how the fluid test should ideally respond.

A nineteenth parameter regarding diagnosing drilling fluid lost circulation and root cause analysis is drill bit torque. Lost circulation may be accompanied by excessive torque and drag when the drill bit rotates or passes through the loss zone. Drilling a highly fractured zone where bit torque varies abnormally can be another indicator for identifying the zone of loss. Drill bit torque may be monitored from the surface using conventional torque measurement sensors.

Figure 9:
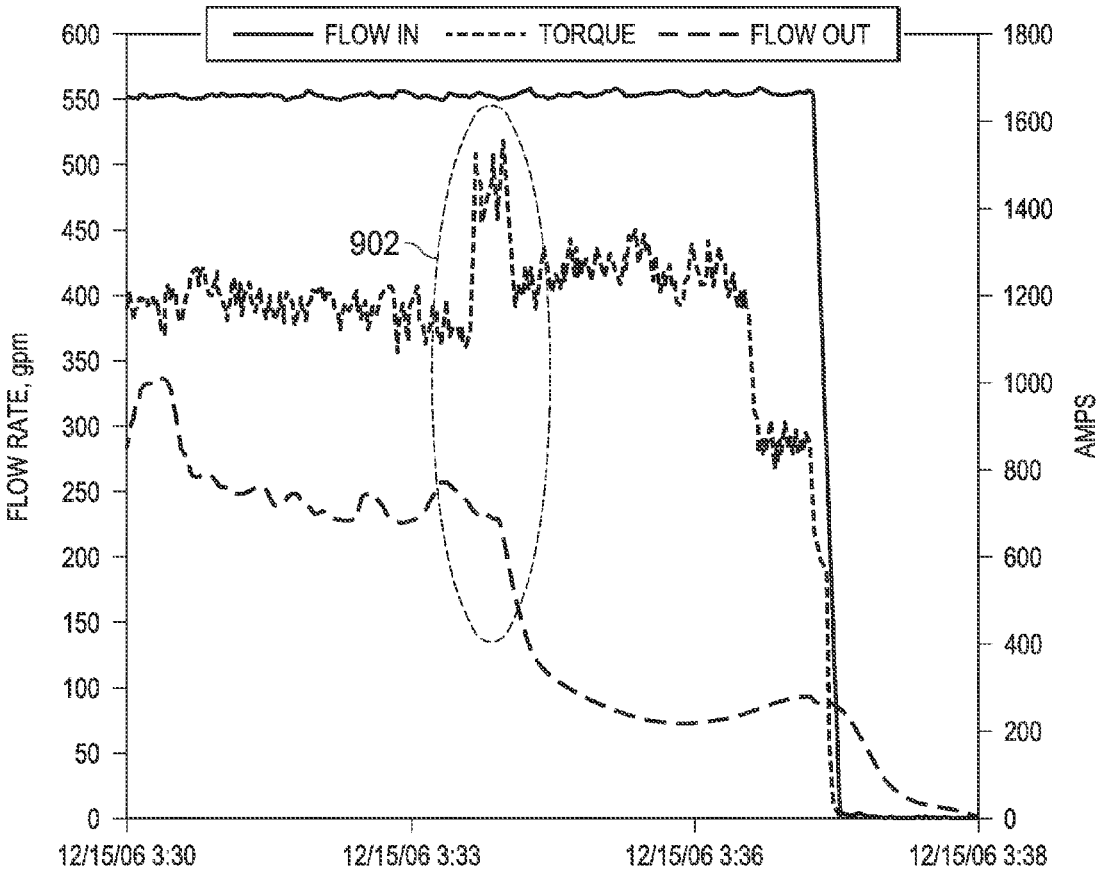
FIG. 9 is a chart depicting an exemplary drill bit torque charted against time.

FIG. 9 is a chart depicting an exemplary drill bit torque charted against time. A sudden change in torque 902 along with a drop in mud flow-out can indicate that abnormally high torque is being experienced when lost circulation is occurring.

A twentieth parameter regarding diagnosing drilling fluid lost circulation and root cause analysis is drilling fluid information. Such information includes drilling fluid type (e.g., water-based or oil based), drilling fluid rheology, and drilling fluid weight (density). Losses can be managed or prevented through proper formulation of drilling fluids. Meanwhile if loss occurs, root cause of losses can be better understood through analyzing formulation and performance of drilling fluid.

A twenty-first parameter regarding diagnosing drilling fluid lost circulation and root cause analysis is the location of the loss zone. Several parameters discussed above (e.g., cumulative loss as a function of drilling depth) may be used to make this determination.

It will be appreciated that the parameters identified above are not necessarily in any order of significance.

III. Mapping Parameters to Drilling Fluid Lost Circulation Causes

Section II above discusses a plethora of parameters and how they may be determined. This section discussed how to use knowledge of these parameters (or a portion thereof) to determine the cause (as discussed in Section I) of drilling fluid lost circulation.

A conclusion that lost circulation is due to seepage may be warranted if the observed parameters match those appearing in Table 1 below.

TABLE 1

| OBSERVATIONS | | TOOLS |
|---|---|---|
| Loss rate most likely less than 10 bph | < > | Rate of loss |
| Losses start as soon as high permeable formation penetrated by the bit. | < > | Losses against depth/ lithology |
| Loss rate increases as more permeable formation is exposed. | < > | Rate of loss<br>Losses against depth/ lithology |
| Torque & drag increases with event of seepage losses | < > | Torque & drag |
| Permeable formation must be exposed. | < > | Porosity/Permeability/ Pore throat size |
| Pore throats are mismatched to particle sizes. | < > | Porosity/Permeability/ Pore throat size |

As represented in Table 1, the following parameters may be used to determine that lost circulation is due to seepage. The rate of loss is low (e.g., less than 10 barrels per hour). Cumulative losses reveal that losses start as soon as a high permeability formation is penetrated by the bit. The torque and drag of the drill bit increases relative to prior torque measurements. Pore information reveals that a permeable formation has been penetrated and that drilling fluid particle sizes are mismatched to pore size.

A conclusion that lost circulation is due to vugular or cavernous formations may be warranted if the observed parameters match those appearing in Table 2 below.

TABLE 2

| OBSERVATIONS | | TOOLS |
|---|---|---|
| Moderate to high loss rate (>10 bph) | < > | Rate of loss |
| Steep change in loss against depth curve | < > | Loss against depth |
| High resistivity generated at the loss zone when OBM is used | < > | Resistivity tool |
| ECD < FG | < > | PP-FG prediction |
| Torque/Drag/ROP increases | < > | Torque/Drag/ROP |
| Vugs/Caverns can be observed in image logs | < > | Image logs |
| Usually occurs in carbonate formations (chalk, limestone) | < > | Lithology |

TABLE 2-continued

| OBSERVATIONS | | TOOLS |
|---|---|---|
| No stable hydrostatic pressure between losses and gains | < > | PWD/ECD |
| Onset at first penetration (bottom of the hole) | < > | Bit depth location |
| Total losses, no gain | < > | Loss/Gain behavior |

As represented in Table 2, the following parameters may be used to determine that lost circulation is due to vugular or cavernous formations. The loss rate is moderate to high (e.g., more than ten barrels per hour). The cumulative losses as a function of depth change sharply. There is a high resistivity at the loss zone when oil-based drilling fluid is used. ECD is less than the fracture gradient. Drill bit torque, drag and penetration rate may suddenly increase. Image logs reveal vugulars or caverns. Lithology may show carbonate formations. Hydrostatic pressure is unstable between losses and gains. Losses start occurring when the drill bit first penetrates the suspected vugular zone. There is no evidence of drilling fluid gain.

A conclusion that lost circulation is due to natural faults may be warranted if the observed parameters match those appearing in Table 3 below.

TABLE 3

| OBSERVATIONS | | TOOLS |
|---|---|---|
| Typically rate of loss > 30 bph | < > | Rate of loss |
| Steep change in loss against depth curve | < > | Loss against depth |
| High resistivity generated at the loss zone when OBM is used | < > | Resistivity tool |
| ECD < FG | < > | PP-FG prediction |
| Sinusoidal cross cutting fracture | < > | Image logs |
| Compliance behavior on PWD at connections | < > | PWD/ECD |
| Significant loss occur once bit touches the natural fracture | < > | Bit depth location |
| Loss is much greater than gain | < > | Loss/Gain behavior |
| Anomalous temperature at loss zone crosses | < > | Temperature surveys |
| Losses decrease when high viscosity fluid reaches the loss zone | < > | Pill behavior |
| May be recognized through seismic analysis | < > | Seismic |

As represented in Table 3, the following parameters may be used to determine that lost circulation is due to natural faults. The loss rate is high (e.g., more than 30 barrels per hour). There is a steep change in cumulative losses. There is a steep change in resistivity when using oil-based drilling fluid. ECD is less than the fracture gradient. Images reveal a sinusoidal fracture. There is compliance behavior on pressure while drilling at connections. Significant losses occur once the drill bit touches the loss zone. Lost drilling fluid greatly outweighs gained drilling fluid. Temperature at the loss zone is different from nearby formations. Losses decrease with high viscosity pill insertion. Seismic data may reveal a natural fault.

A conclusion that lost circulation is due to borehole breathing may be warranted if the observed parameters match those appearing in Table 4 below.

TABLE 4

| OBSERVATIONS | | TOOLS |
|---|---|---|
| More than 30 bph after pump on and decreases quickly with time | < > | Rate of loss |

TABLE 4-continued

| OBSERVATIONS | | TOOLS |
|---|---|---|
| High resistivity generated at the loss zone when OBM is used | < > | Resistivity tools |
| ECD is close to FG at loss zone | < > | PP-FG prediction |
| Typically losses in shale formation | < > | Lithology |
| Compliance behavior on PWD at connections | < > | PWD/ECD |
| Salinity of mud may be higher than that of shale formation | < > | Salinity information |
| Usually gives back what was lost when the ECD is reduced | < > | Loss/Gain behavior |
| Flow back rate decreases with time | < > | Loss/Gain behavior |
| Sometimes gives connection gas | < > | Loss/Gain behavior |

As represented in Table 4, the following parameters may be used to determine that lost circulation is due to borehole breathing. When the pump is turned on, a large rate of loss is observed (e.g., more than thirty barrels per hour), which then decrease quickly with time. When oil-based drilling fluid is used, high resistivity is detected in the loss zone. ECD is close to the fracture gradient in the loss zone. Lithology typically reveals shale. There is compliance behavior on pressure while drilling at connections. Salinity of the drilling fluid may be higher than that of a shale formation. Lost drilling fluid is typically regained when ECD is reduced, with the flow back rate decreasing with time. There is sometimes connection gas.

A conclusion that lost circulation is due to induced vertical fractures may be warranted if the observed parameters match those appearing in Table 5 below.

TABLE 5

| OBSERVATIONS | | TOOLS |
|---|---|---|
| Typically rate of loss > 30 bph | < > | Rate of loss |
| Can be any point in the open hole | < > | Loss against depth |
| High resistivity generated at the loss zone when OBM is used | < > | Resistivity tool |
| Losses starts with ECD > FBP (formation breakdown pressure) and continues with ECD > $S_h$ | < > | PP-FG prediction |
| Losses decrease when high viscous fluid reaches loss zone | < > | Pill behavior |
| Symmetric fracture axial to the wellbore | < > | Image logs |
| Typically starts in sand or silt and spreads in shale | < > | Lithology |
| Normal stress regime ($S_v$ > $S_H$ > $S_h$) | < > | Tectonic region |
| Abnormal ECD increase possibly due to pack-off, surge etc. | < > | PWD/ECD |
| Abnormal temperature at loss zone | < > | Temperature surveys |
| Loss is much greater than gain | < > | Loss/Gain behavior |

As represented in Table 5, the following parameters may be used to determine that lost circulation is due to induced vertical fractures. There is a high loss rate, e.g., greater than 30 barrels per hour. Location may be anywhere. High resistivity is obtained in the loss zone when oil-based drilling fluid is used. Losses start when ECD exceeds formation breakdown pressure and continues when ECD exceeds the minimum horizontal stress. Losses decrease when a high-viscosity pill reaches the loss zone. Images reveal a symmetric fracture axial to the wellbore. Induced vertical fractures typically start in sand or silt and spread to shale. The tectonic regime is normal. The loss circulation event may have been caused by an abnormal increase in ECD possibly due to a sudden restriction to flow (by cuttings etc.). There is an abnormal temperature in the loss zone. Lost drilling fluid exceeds gained drilling fluid.

A conclusion that lost circulation is due to induced horizontal fractures may be warranted if the observed parameters match those appearing in Table 6 below.

TABLE 6

| OBSERVATIONS | | TOOLS |
|---|---|---|
| Typically rate of loss > 30 bph | < > | Rate of loss |
| Can be any point in the open hole | < > | Loss against depth |
| High resistivity generated at the loss zone when OBM is used | < > | Resistivity tool |
| Losses starts with ECD > FBP (formation breakdown pressure) and continues with ECD > $S_v$ | < > | PP-FG prediction |
| Losses decrease when high viscosity fluid reaches loss zone | < > | Pill behavior |
| Typical starts in sand or silt and spreads in shale | < > | Lithology |
| Reverse in-situ stress region ($S_H > S_h > S_v$) | < > | Tectonic region |
| Abnormal ECD increase possibly due to pack-off, surge etc. | < > | PWD/ECD |
| Abnormal temperature at loss zone | < > | Temperature surveys |
| Loss is much greater than gains | < > | Loss/Gain behavior |

As represented in Table 6, the following parameters may be used to determine that lost circulation is due to induced horizontal fractures. There is a high loss rate, e.g., greater than 30 barrels per hour. Location may be anywhere. High resistivity is obtained in the loss zone when oil-based drilling fluid is used. Losses start when ECD exceeds formation breakdown pressure and continues when ECD exceeds the minimum horizontal stress. Losses decrease when a high-viscosity pill reaches the loss zone. Induced vertical fractures typically start in sand or silt and spread to shale. The tectonic regime is usually reverse in-situ stress (maximum horizontal stress>minimum horizontal stress>overburden). The loss circulation event may have been caused by an abnormal increase in ECD possibly due to a sudden restriction to flow (by cuttings etc.). There is an abnormal temperature in the loss zone. Lost drilling fluid exceeds gained drilling fluid.

A conclusion that lost circulation is due to a hole in the casing may be warranted if the observed parameters match those appearing in Table 7 below.

TABLE 7

| OBSERVATIONS | | TOOLS |
|---|---|---|
| Loss rate varies depending upon the size and location of the channel | < > | Rate of loss |
| Losses occur below fracture gradient expected at the shoe | < > | PP-FG |
| Losses decreases when high viscous fluid reaches the hole in casing | < > | Pill behavior |
| Will induce losses into a shallow formation up the well | < > | Bit depth location |
| Casing can not hold pressure | < > | Casing test/packer |

As represented in Table 7, the following parameters may be used to determine that lost circulation is due to a hole in the casing. The loss rate varies depending on the size and location of the channel. Losses occur below the fracture gradient expected at the shoe. Losses decrease when a high-viscosity pill reaches the loss zone. Losses may be induced into a shallow formation higher up on the wellbore. The casing itself fails a pneumatic pressure test.

A conclusion that lost circulation is due to ineffective isolation of the casing shoe may be warranted if the observed parameters match those appearing in Table 8 below.

TABLE 8

| OBSERVATIONS | | TOOLS |
|---|---|---|
| Loss rate will vary case by case depending upon the size of the channel | < > | Rate of loss |
| Losses start when ECD is less than FG at shoe | < > | PP-FG prediction |
| LOT would be lower than normal for that depth | < > | LOT behavior |
| Slope of Leak Off is less than the slope of casing test | < > | LOT behavior |
| Cannot use LOT to diagnose the low LOT when permeable formation is present below the shoe | < > | LOT/FIT analyzing tool Lithology |
| Losses decrease when high viscous fluid is at the shoe | < > | Pill behavior |
| Cooling effects behind the casing | < > | Temperature survey |

As represented in Table 8, the following parameters may be used to determine that lost circulation is due to ineffective isolation of the casing shoe. The loss rate varies depending upon the size of the channel. Losses begin when ECD is less than the predicted fracture gradient at the shoe. The leak-off test (measure of the fracture strength of the formation under the casing shoe) is less that the predicted value, because it is actually measuring fracture strength of a shallower formation behind casing. The slope of the pressure build-up profile is less than that of the casing test because of the presence of the channel (transmitting pressure behind casing). Losses decrease when a high-viscosity pill reaches the shoe. The temperature at the casing shoe is lower than surrounding temperatures.

IV. Remedies and Preventative Measures

This section discusses various remedial and preventative measures that may be employed to treat or prevent each of the eight loss mechanisms discussed herein.

Losses due to seepage may be both remedied and prevented by introducing particle sizes that are matched to the pore throat size of the formation into the drilling fluid.

For losses due to vugulars or caverns, remedial measures are generally limited to cementing, e.g., using a squeeze cementing procedure.

Losses due to vugulars or caverns may be minimized or prevented by incorporating filament fibers into the drilling fluid, by using a high gel drilling fluid, or aerating the drilling fluid. Losses can also be prevented or managed via pills that can be placed across the vugular zone such as cross-linked polymers, high thixotropic fluid, and high fluid loss pills. Another prevention strategy includes the use of mud cap or Managed Pressure Drilling strategies.

For losses due to natural faults, the following remedial measures may be used. A filament fiber pill may be used as a temporary measure. A high fluid loss pill which may/may not develop compressive strength or a cross link polymer pill may also be used. Cement (e.g., a squeeze cementing treatment) is another remedial treatment.

Losses due to natural faults may be prophylactically managed by the use of a pre-treatment with a sealing agent.

For losses due to borehole breathing, the following remedial measures may be used. ECD should be reduced such that it is below the far-field fracture gradient. This could be achieved by making changes to: drilling fluid weight; rate of penetration; fluid viscosity; and RPM. Additionally, the drilling fluid may be heated.

For losses due to borehole breathing, the following preventative measures may be used. Similar to the remedial measures, ECD should be managed by adjusting: drilling fluid weight; rate of penetration; fluid viscosity; and RPM. Other preventative strategies include employing a flat rheology mud system, a dual gradient drilling system or a continuous circulating drilling system. ECD can also be managed by utilization of specialized ECD reduction tools or by swab/surge reduction tool. Salinity should also be adjusted to match that of the formation. Additionally, drilling fluid may be heated.

For losses due to induced vertical fractures, the following remedial measures may be used. ECD may be reduced by adjusting the weight of the drilling fluid, the rate of penetration or the drilling fluid flow rate. Cement with $CaCO_3$ or a resin with bridging solids may be squeezed into the fracture. Filament fibers incorporated into the drilling fluid may be used. A casing, liner or solid expandable tubing may be used.

For losses due to induced vertical fractures, the following preventative measures may be used. ECD may be reduced by adjusting the weight of the drilling fluid, the rate of penetration or the drilling fluid flow rate. A drilling fluid with $CaCO_3$ particles may be introduced to increase the fracture gradient of sand. A casing, liner or solid expandable tubing may be used.

For losses due to induced horizontal fractures, the following remedial measures may be used. ECD may be reduced by adjusting the weight of the drilling fluid, the rate of penetration or the drilling fluid flow rate. Filament fibers incorporated into the drilling fluid may be used. A high fluid loss pill which develops compressive strength may also be used for sand formations. A casing, liner or solid expandable tubing may be used.

For losses due to induced horizontal fractures, the following preventative measures may be used. ECD may be reduced by adjusting the weight of the drilling fluid, the rate of penetration and the drilling fluid flow rate. A casing, liner or solid expandable tubing may be used.

For losses due to a perforated casing, the following remedial measures may be used. A cement squeeze may be used. A casing patch may be used. A lost circulation material may be introduced.

For losses due to ineffective isolation of the casing shoe, the following remedial measures may be used. Cement or a pill containing a cross-linked polymer may be squeezed to plug off any channels. Filament fibers can be incorporated into the drilling fluid. A drilling fluid with $CaCO_3$ particles may be introduced. A high fluid loss pill which may/may not develop compressive strength or a cross link polymer pill may also be used for situations where the loss rate is moderate to high.

Figure 10:
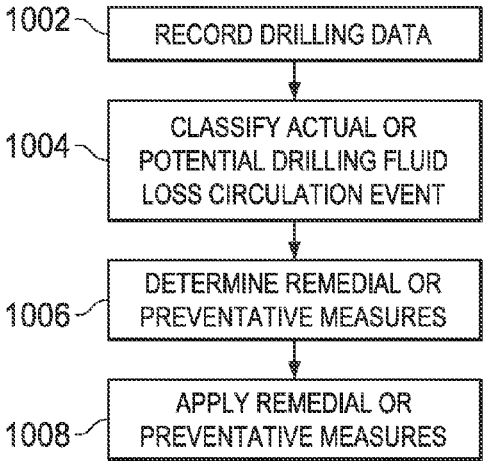
FIG. 10 is a flow diagram illustrating an example method according to an embodiment of the disclosure.

FIG. 10 is a flow diagram illustrating an exemplary method according to an embodiment of the disclosure. At block 1002, data regarding an actual or potential drilling fluid lost circulation event are recorded. Section II discusses this step in detail. The recording may include recording on electronic media, paper media, or any other persistent medium. At block 1004, the actual or potential drilling fluid lost circulation event is classified as being due to (or potentially due to) one of several causes. The causes are discussed in detail above in Section I; while techniques for classification based on the data gathered at block 1002 are discussed in detail above in Section III. At block 1006, remedial or preventative measures are determined. This step is discussed in detail above in Section IV. At block 1008, the remedial or preventative measures are applied. This step is discussed in detail above in Section IV.

Note that many of the steps recited herein may be automated using installed executable software. For example, the parameters discussed in Section II may be stored in an electronic database. Pattern matching algorithms, e.g., support vector machines, may be used to map the parameters to the causes discussed in Section I. The software may automatically retrieve stored data regarding remedies or preventative measures that correspond to the disclosed causes. The software may be implemented on a computer, such as a personal computer executing an operating system.

While the present disclosure has been described according to its preferred embodiments, it is of course contemplated that modifications of, and alternatives to, these embodiments, such modifications and alternatives obtaining the advantages and benefits of this disclosure, will be apparent to those of ordinary skill in the art having reference to this specification and its drawings. It is contemplated that such modifications and alternatives are within the scope of this disclosure as subsequently claimed herein.

What is claimed is:

1. A method of diagnosing a cause of a drilling fluid lost circulation event, the method comprising:

recording data regarding: a rate of drilling fluid loss at the time of the event, cumulative drilling fluid losses as a function of drilling depth, borehole material electrical resistivity as a function of drilling depth, a predicted pore pressure at the time of the event, a predicted fracture gradient at the time of the event, leak-off test behavior prior to or at the time of the event, porosity and permeability information of material at an estimated location of the event, a rate of drilling fluid loss at a time after a lost circulation pill treatment, a borehole image, gamma ray emissions of material at an estimated location of the event, a tectonic regime of material at an estimated location of the event, an equivalent circulation density at an estimated location of the event, borehole temperature as a function of drilling depth, drilling fluid salinity, presence of fractures at an estimated location of the event, fault conductivity at an estimated location of the event, drilling fluid gain when drilling fluid is not being pumped, borehole trajectory, and drill bit drag and penetration rate at the time of the event;

classifying, based on the data, the event as at least one of: seepage, borehole breathing, induced axial fracture, induced near-orthogonal fracture, natural fracture, vugulars, and ineffective isolation of casing shoe;

determining remedial measures, based on the classifying, to at least partially cure the event; and implementing the remedial measures.

2. The method of claim 1, wherein the measures comprise reducing an equivalent circulation density.

3. The method of claim 1, wherein the measures comprise pumping a lost circulation pill.

4. The method of claim 3, wherein the lost circulation pill comprises $CaCO_3$.

5. The method of claim 3, wherein the lost circulation pill comprises filament fiber.

6. The method of claim 3, wherein the lost circulation pill comprises graphite.

7. The method of claim 3, wherein the lost circulation pill comprises cement.

8. The method of claim 3, wherein the lost circulation pill comprises resin.

9. The method of claim 3, wherein the lost circulation pill comprises cross-linked polymers.

10. The method of claim 3, wherein the lost circulation pill comprises aerated mud.

11. The method of claim 1, wherein the measures comprise optimizing drilling fluid salinity.

12. The method of claim 1, wherein the measures comprise reducing a weight of the drilling fluid.

13. The method of claim 1, wherein the measures comprise reducing a rate of penetration.

14. The method of claim 1, wherein the measures comprise increasing a temperature of the drilling fluid.

15. A method of predicting and preventing a potential drilling fluid circulation loss event, the method comprising:

recording data regarding: a rate of drilling fluid loss at the time of the event, cumulative drilling fluid losses as a function of drilling depth, borehole material electrical resistivity as a function of drilling depth, a predicted pore pressure at the time of the event, a predicted fracture gradient at the time of the event, leak-off test behavior prior to or at the time of the event, porosity and permeability information of material at an estimated location of the event, a rate of drilling fluid loss at a time after a lost circulation pill treatment, a borehole image, gamma ray emissions of material at an estimated location of the event, a tectonic regime of material at an estimated location of the event, an equivalent circulation density at an estimated location of the event, borehole temperature as a function of drilling depth, drilling fluid salinity, presence of fractures at an estimated location of the event, fault conductivity at an estimated location of the event, drilling fluid gain when drilling fluid is not being pumped, borehole trajectory, and drill bit drag and penetration rate at the time of the event;

classifying, based on the data, the potential drilling fluid circulation loss event as at least one of: seepage, borehole breathing, induced axial fracture, induced near-orthogonal fracture, natural fracture, vugulars, and casing hole;

determining preventative measures to prevent the potential drilling fluid circulation loss event from occurring; and implementing the preventative measures.

16. The method of claim 15, wherein the measures comprise reducing an equivalent circulation density.

17. The method of claim 15, wherein the measures comprise pumping a lost circulation pill.

18. The method of claim 17, wherein the lost circulation pill comprises $CaCO_3$.

19. The method of claim 17, wherein the lost circulation pill comprises filament fiber.

20. The method of claim 17, wherein the lost circulation pill comprises graphite.

21. The method of claim 17, wherein the lost circulation pill comprises cement.

22. The method of claim 17, wherein the lost circulation pill comprises resin.

23. The method of claim 17, wherein the lost circulation pill comprises cross-linked polymers.

24. The method of claim 17, wherein the lost circulation pill comprises aerated mud.

25. The method of claim 15, wherein the measures comprise optimizing drilling fluid salinity.

26. The method of claim 15, wherein the measures comprise reducing a weight of the drilling fluid.

27. The method of claim 15, wherein the measures comprise reducing a rate of penetration.

28. The method of claim 15, wherein the measures comprise increasing a temperature of the drilling fluid.

* * * * *